US007963621B1

(12) United States Patent
Ellis

(10) Patent No.: US 7,963,621 B1
(45) Date of Patent: Jun. 21, 2011

(54) MULTI PEGBOARD SURFACE TOOL CABINET

(76) Inventor: John E. Ellis, Tulsa, OK (US)

( * ) Notice: Subject to any disclaimer, the term of this patent is extended or adjusted under 35 U.S.C. 154(b) by 4 days.

(21) Appl. No.: 11/999,113

(22) Filed: Dec. 4, 2007

(51) Int. Cl.
*A47B 67/02* (2006.01)

(52) U.S. Cl. ..... 312/242

(58) Field of Classification Search ..... 312/242, 312/245, 224, 326, 329, 34.24, 226, 227; 211/70.6

See application file for complete search history.

(56) References Cited

U.S. PATENT DOCUMENTS 809,592 A * 1/1906 Watts, Jr. ..... 312/242
891,389 A * 6/1908 Watts ..... 312/242
3,620,404 A * 11/1971 Grasso ..... 220/477
4,118,085 A 10/1978 Fibus
4,155,609 A 5/1979 Skafte et al.
4,285,556 A * 8/1981 Loeffel ..... 312/244
4,681,380 A 7/1987 Carlin
4,753,495 A 6/1988 Swink
5,468,063 A 11/1995 Simonek
5,513,574 A 5/1996 Collins
5,577,819 A * 11/1996 Olsen ..... 312/242
5,954,410 A 9/1999 Noellert
5,970,663 A 10/1999 McDonough
5,992,956 A * 11/1999 Slivon ..... 312/334.25
6,039,416 A 3/2000 Lambert
6,578,938 B2 6/2003 Norman et al.
6,945,615 B1 9/2005 Cain
7,044,178 B1 * 5/2006 Campbell ..... 144/285
7,051,884 B2 5/2006 Dick
2002/0117945 A1 8/2002 Norman et al.
2005/0016943 A1 1/2005 Dick
2007/0151302 A1 7/2007 Kendall et al.

* cited by examiner

*Primary Examiner* — James O Hansen
(74) *Attorney, Agent, or Firm* — Gable Gotwals

(57) ABSTRACT

A pegboard-type tool cabinet can be mounted in a garage wall with the cabinet door flush with garage wall and provide three pegboard tool hanging surfaces in the single surface wall area. The cabinet thus maximizes available pegboard space without intrusion into the available garage space.

7 Claims, 5 Drawing Sheets

MULTI PEGBOARD SURFACE TOOL CABINET

BACKGROUND OF INVENTION

This invention relates generally to storage cabinets and more particularly concerns cabinets for storing household tools.

The primary purpose of pegboard is to convert a wall surface, very often an inside garage wall, into an easily accessible storage area for hanging household tools. The pegboard is typically mounted directly on the front faces of the wall studs or, if wall board is already covering the studs, mounted on spacers on the front face of the wall board. Pegboard mounted in this fashion affords a single surface on which tools can be stored for easy access. Such pegboard systems do not create additional storage space but only make the already available space easier to use.

Rolling and floor-mounted cabinets incorporate multiple pairs of front-to-rear upper and lower channels so that multiple pegboards can slide edgewise into the cabinet and free standing posts will support pegboard at any desirable place on a room floor, but they permanently intrude into the garage or other room space defined by the walls. Pegboard ceiling panels swing down and abut the wall below but they render the normally exposed wall and ceiling surfaces both generally unusable. Furthermore, the swinging pegboard panel itself is unusable when a rolling garage door is raised on its tracks and covers the closed pegboard ceiling panel.

In sum, while the use of pegboard is long known and many efforts have been made to maximize pegboard storage space, there has heretofore been no success in conceiving a pegboard storage configuration which creates pegboard storage space greater than available wall space without decreasing available floor or room space.

It is, therefore, an object of this invention to provide a tool cabinet which increases tool storage surface area without decreasing available floor or room space. Another object of this invention is to provide a tool cabinet which converts the between-stud space covered by a section of wall board into multiple pegboard-type tool storage surfaces in the same space.

SUMMARY OF INVENTION

In accordance with the invention, a tool cabinet is provided which can be mounted in a wall which consists of a wall cover panel such as plasterboard, pegboard or other type of wall board attached to studs which are spaced apart behind and covered by the wall board.

The cabinet includes a box covered by a hinged front door. The box is preferably substantially orthogonal. The maximum outside width of the box is not greater than the width of the space between adjacent spaced-apart studs. The maximum outside depth of the box, taken from the front face of the hinged door to the rear face of the box, is less than the depth from the front face of the wall cover panel to the rear face of the studs supporting the wall panel. This maximum box depth provides a rear cavity behind the box and between the studs when the box is positioned between the studs with the front face of its hinged door flush with the front face of the wall cover panel. The rear panel of the box has a first array of peg holes dispersed through it In one embodiment of the cabinet, preferred when the wall cover panel includes a single sheet of plasterboard, pegboard or other type of wall board, the door has a frame with a front panel with a second array of peg holes dispersed through it. In another embodiment of the cabinet, preferred when the wall cover panel is a laminar arrangement of two boards and spacers, the door is a laminar arrangement of two panels with spacers defining a cavity in the door. In this embodiment, the second array of peg holes is dispersed through one of the laminar panels and a third array of peg holes is dispersed through the other of the laminar panels. Pegs used with the cabinet peg hole arrays are shaped to include tool hangers and mounting shanks, such as those pegs typically used with pegboards.

In the first embodiment, pegs can be mounted on either or both of the peg hole arrays. The hangers can extend from the front face of the box rear panel with their shanks through holes of the first array and extending into the rear cavity behind the box. The hangers can extend from the rear face of the door into the box with their shanks through holes of the second array and extending forward of the door. The hangers can also extend from the front face of the door with their shanks through the holes of the second array and extending into the box. Thus tools can be stored against three different wall surfaces, two inside the cabinet and one to the front of the cabinet, on two arrays of peg holes.

In the second embodiment, pegs can be mounted on any or all of the three peg hole arrays. The hangers can extend from the front face of the box rear panel with their shanks through holes of the first array and extending into the rear cavity behind the box. The hangers can extend from the rear face of the door with the shanks extending through the peg holes of the second array and forwardly into the door cavity. The hangers can extend from the front face of the door with the shanks extending through the peg holes of the third array and rearwardly into the door cavity.

It is preferred that the door has a depth substantially equal to the depth of the wall cover panel and, while each embodiment preferably utilizes a hinged cover configured to match its corresponding wall cover panel, single panel doors can be used with two panel walls and two panel doors with single panel wall.

BRIEF DESCRIPTION OF THE DRAWINGS

Other objects and advantages of the invention will become apparent upon reading the following detailed description and upon reference to the drawings in which.

While the invention will be described in connection with one or more preferred embodiments thereof, it will be understood that it is not intended to limit the invention to those embodiments or to the details of the construction or arrangement of parts illustrated in the accompanying drawings.

DETAILED DESCRIPTION

Figure 1:
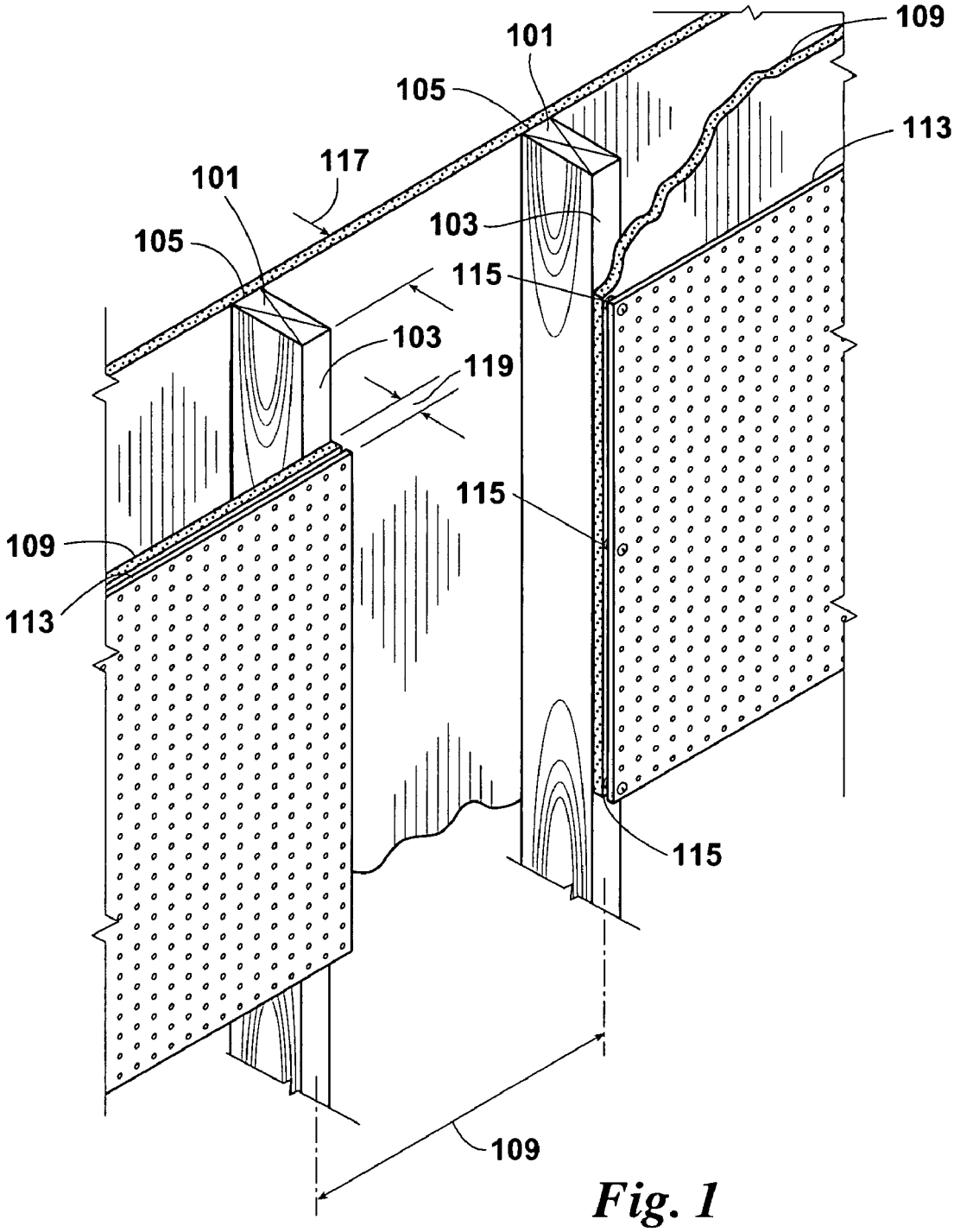
Fig. 1 (PRIOR ART)
FIG. 1 is a perspective view illustrating a typical wall environment in which a tool cabinet can be installed.

Turning first to FIG. 1, a typical garage, attic or storage room wall 100 may be constructed using a frame with studs 101 having front and back faces 103 and 105. In some cases, an inside wall cover panel 107, such as plasterboard or other type of wall board, of an adjoining room is fastened against the back faces 105 of the studs 101. In other cases, an exterior wall, such as brick, extends behind or against the back faces 105 of the studs 101. In either case, an inside wall cover panel, such as plasterboard 109, pegboard or other type of wall board, is fastened against the front faces 103 of the studs 101 of the garage, attic or storage room. The studs 101 are typically spaced 111 on 16" centers. If, as shown in FIG. 1, the inside cover wall panel is plasterboard 109, pegboard 113 may be fastened to the plasterboard 109 and studs 101 with spacers 115 between the boards 109 and 113. If, as shown, the wall cover panel 109 and the pegboard 113, if any, are removed or not applied between an adjacent pair of studs 101, a frontally accessible space results of depth equal to the depth 117 of the studs 101 plus the depth 119 from the front faces 103 of the studs 101 to the front faces of the cover panel 109 or the pegboard 113, if any.

Figure 3:
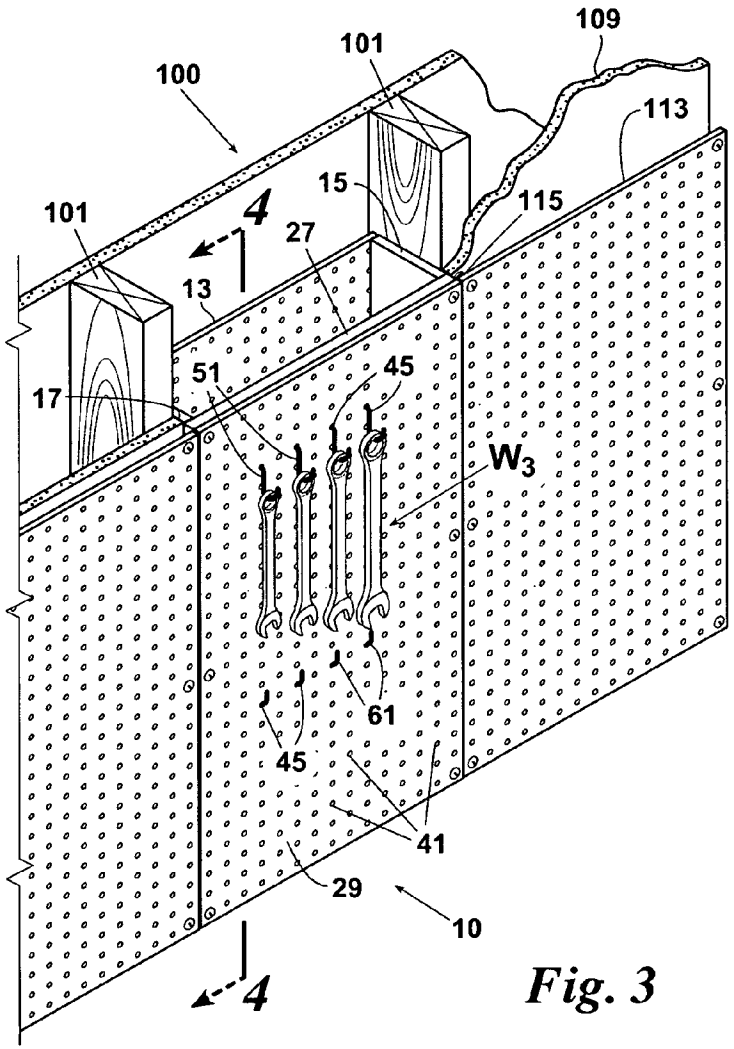
FIG. 3 is a perspective view of the tool cabinet of FIG. 1 with the door shut.
Figure 2:
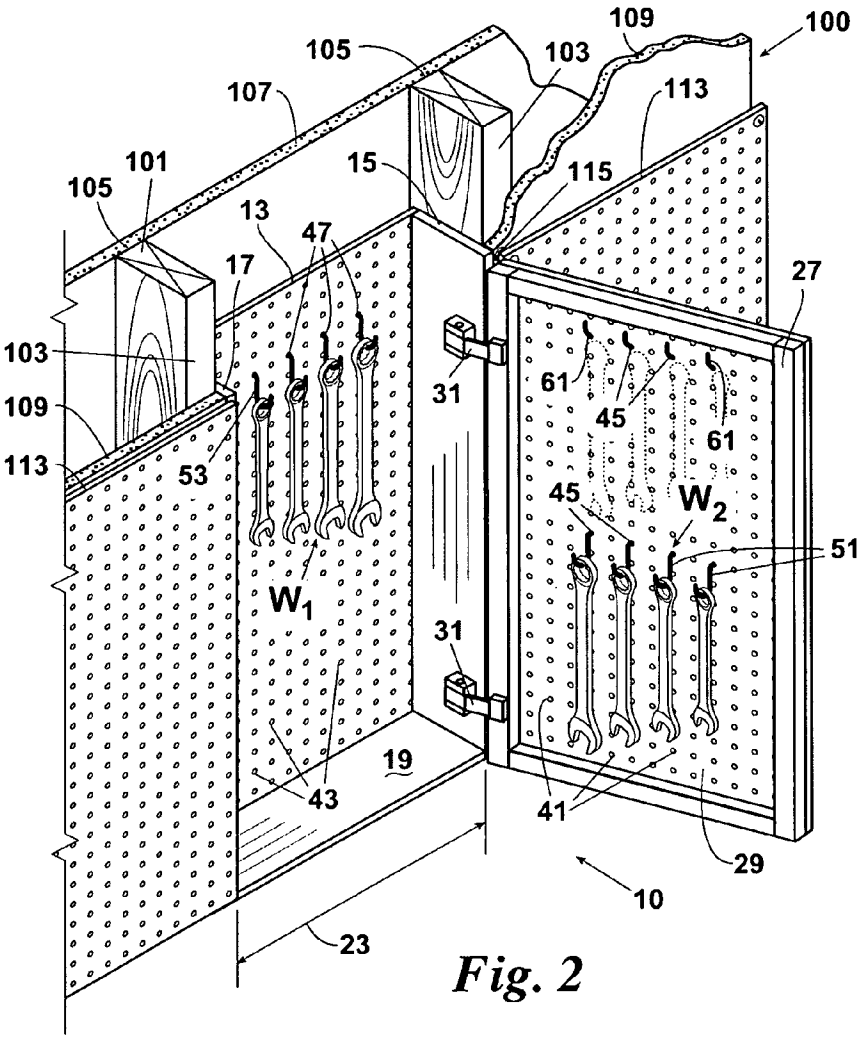
FIG. 2 is a perspective view of a first embodiment of the tool cabinet with its door open.
Figure 4:
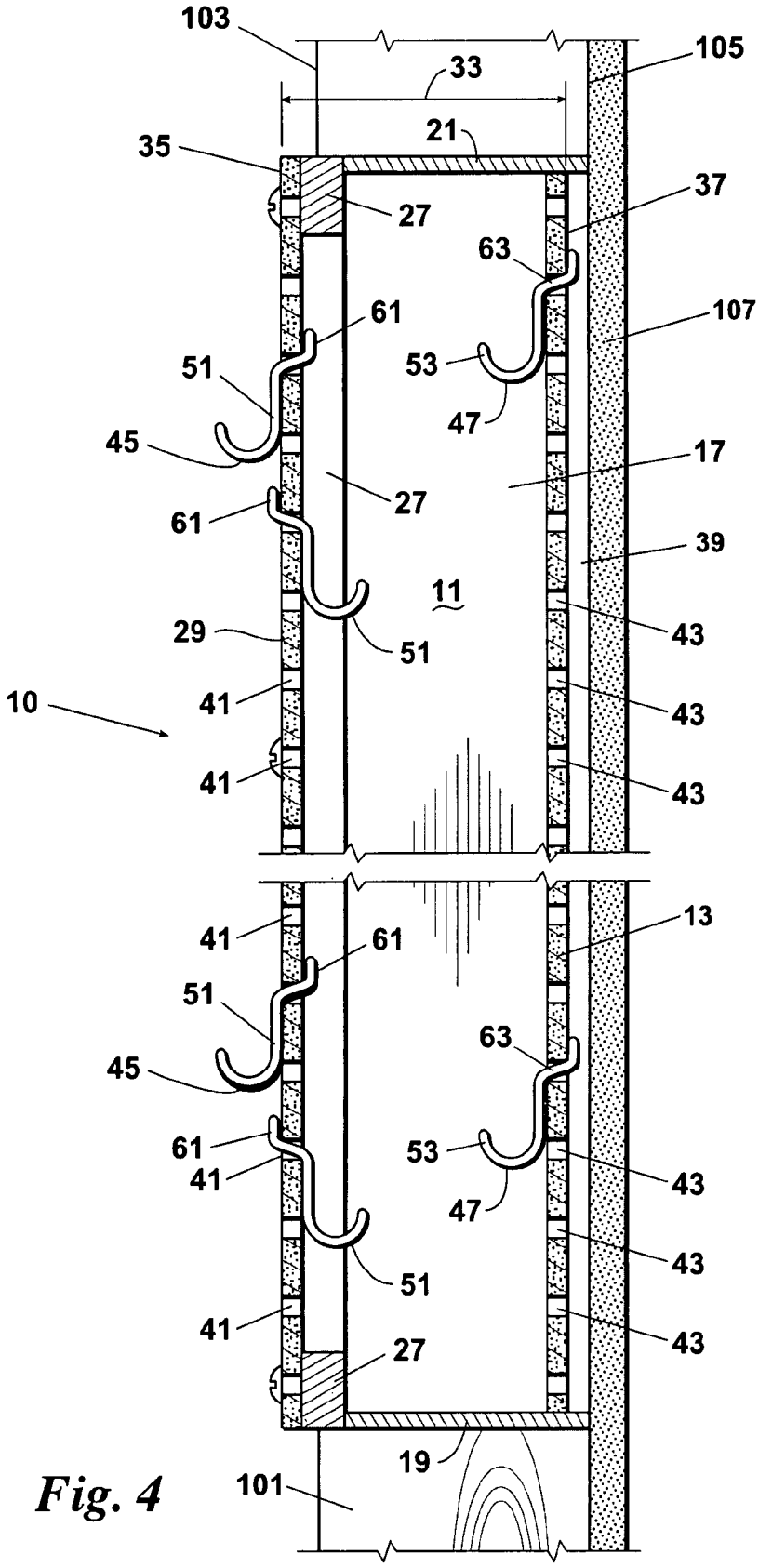
FIG. 4 is a cross-sectional view taken along the line 4-4 of FIG. 2.

Looking now at FIGS. 2-4, there is shown a first embodiment of a cabinet 10 which takes advantage of this space between the studs 101 and its surrounding wall structure to efficiently store household tools, such as the wrench sets $W_1$, $W_2$ and $W_3$. The cabinet 10 shown is an open box 11 with a rear panel 13. Sides 15 and 17, a bottom 19 and a top 21 (not shown in FIGS. 2 and 3) extend forwardly from the perimeter of the rear panel 13. The box 11 has a maximum outside width 23 which is not greater than the width 109 of the space between adjacent spaced-apart studs 101.

Continuing to look at FIGS. 2-4, the interior of the box 11 is accessible through a door 25 including a frame 27 and a front panel 29 fixed to the frame 27. The frame 27 of the door 25 is secured to a side 15 of the box 11 by hinges 31. As best seen in FIG. 4, the maximum outside depth 33 from the front face 35 of the door 25 to the rear face 37 of the box 11 is less than the distance from the rear face of the back panel 13 to the front face of the wall cover panel 109 or the wall pegboard 113, if any. Thus, a cavity 39 is formed between the rear panel 13 of the box 11 and the back faces 105 of the studs 101.

Still looking principally at FIG. 4, the front panel 29 of the door 25 is made of pegboard or of other material through which an array of peg holes 41 is dispersed. The rear panel 13 of the box 11 is also made of pegboard or of other material through which another array of peg holes 43 is dispersed. The pegs 45 and 47 used with the front and rear panels 29 and 13 of the door 25 and box 13 of the cabinet 10 have front hangers 51 and 53, respectively, and rear shanks 61 and 63, respectively. The pegs 45 and 47 can be mounted on the cabinet 10 in three ways. The rear panel pegs 47 can be mounted with their hangers 53 extending from the front face of the rear panel 13 with their shanks 63 extending into the rear cavity 39 behind the box 11. The front panel pegs 45 can be mounted with their hangers 51 extending from the rear face of the front door panel 29 into the box 13 with their shanks 61 extending forward of the front door panel 29. The front panel pegs 45 can also be mounted with their hangers 51 extending from the front face 35 of the front door panel 29 with their shanks 61 extending into the box 13. Thus tools $W_1$, $W_2$ and $W_3$ can be stored against three different wall surfaces, two inside the cabinet 10 and one to the front of the cabinet 10.

Figure 6:
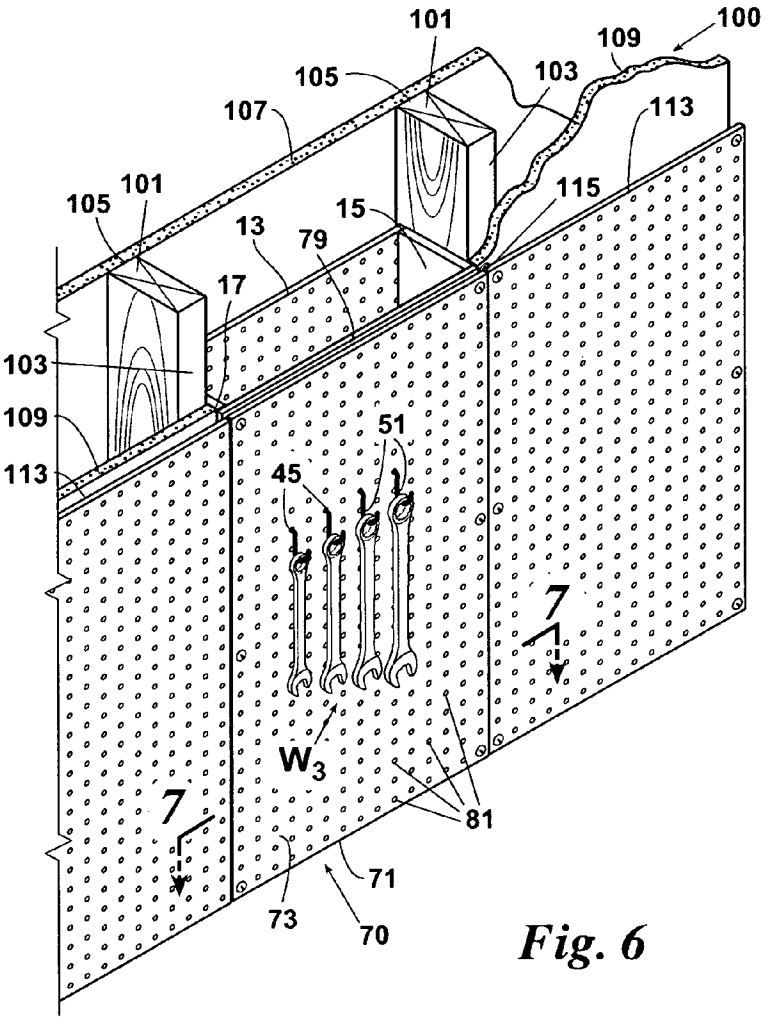
FIG. 6 is a perspective view of the tool cabinet of FIG. 5 with the door shut.
Figure 5:
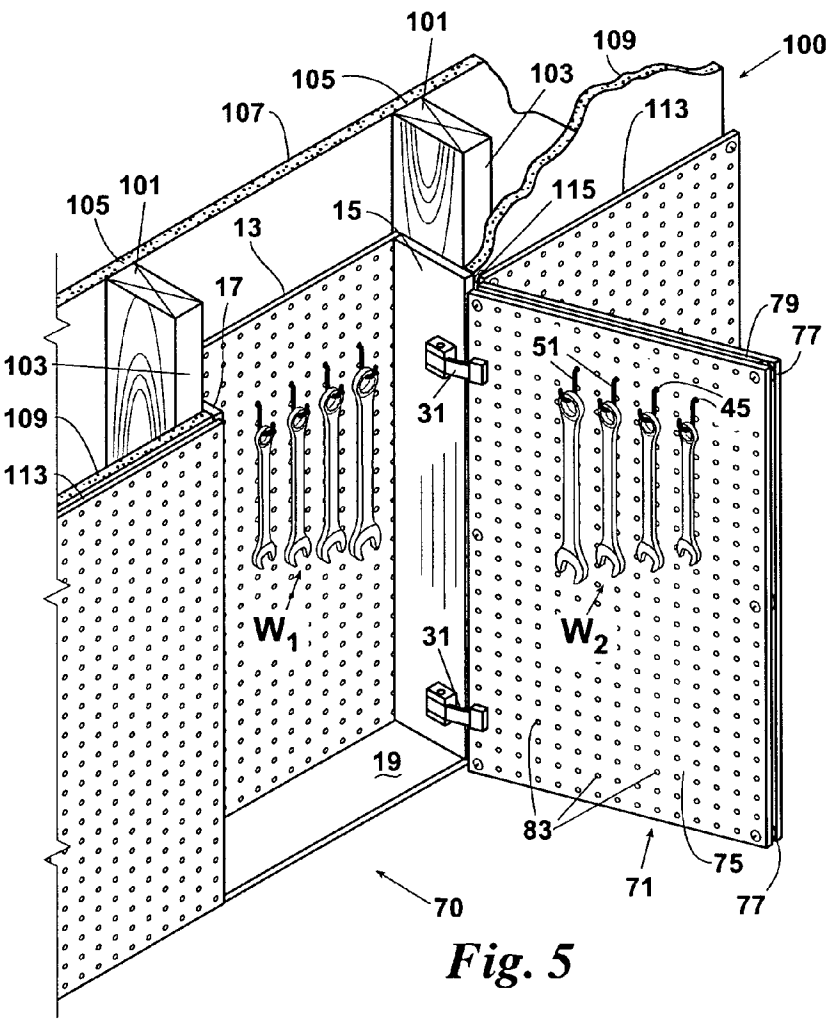
FIG. 5 is a perspective view of a second embodiment of the tool cabinet with its door open.
Figure 7:
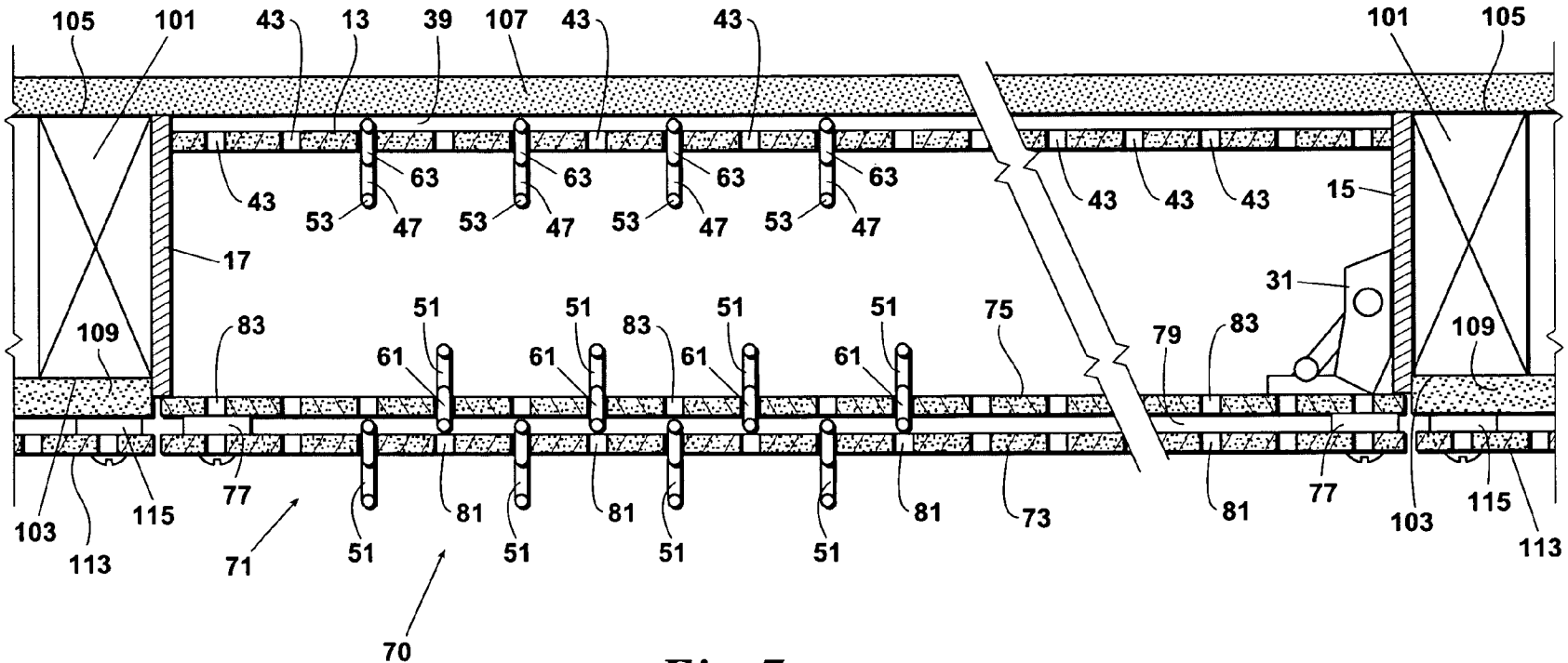
FIG. 7 is a cross-sectional view taken along the line 7-7 of FIG. 5 with the door shut.

In another embodiment seen in FIGS. 5-7, preferred when the wall cover panel is a laminar arrangement of two boards 109 and 113 with spacers 115 as seen in FIG. 1, the cabinet 70 is similar in all respects to the already described cabinet 10. One difference is that the door 71 is a laminar arrangement of front and back panels 73 and 75 with spacers 77 defining a cavity 79 in the door 71. Another difference is that the hinges 31 are secured to the rear face of the back laminar panel 75 and one of the side walls 15. In this embodiment, each of the front and back laminar panels 73 and 75 has an array of peg holes 81 and 83, respectively, dispersed through it. The front panel pegs 45 can be mounted with their hangers 51 extending from the rear face of the rear laminar panel 77 into the box 13 with their shanks 61 extending into the door cavity 79. The front panel pegs 45 can also be mounted with their hangers 51 extending from the front face 35 of the front laminar panel 75 with their shanks 61 extending into the door cavity 79. Thus tools $W_1$, $W_2$ and $W_3$ can, in this embodiment also, be stored against three different wall surfaces, two inside the cabinet 70 and one to the front of the cabinet 70.

The pegs 45 and 47 are typically used with known pegboards 101. While the cabinets 10 and 70 have been described in reference to preferences related to the structure of the walls in which they are mounted, either cabinet 10 or 70 can be mounted in a wall structure for which the other is preferred. The cabinets 10 and 70 may be left or right hand hinged or may have double doors and folding doors.

Thus, it is apparent that there has been provided, in accordance with the invention, a tool cabinet that fully satisfies the objects, aims and advantages set forth above. While the invention has been described in conjunction with one or more specific embodiments thereof, it is evident that many alternatives, modifications and variations will be apparent to those skilled in the art in light of the foregoing description. Accordingly, it is intended to embrace all such alternatives, modifications and variations as fall within the scope of the appended claims.

What is claimed is:

1. A combination comprising:

a wall cover panel attached to spaced-apart studs; and a tool cabinet comprising a box having a hinged front door, a maximum outside width of said box being not greater than a width of a space between adjacent ones of said spaced-apart studs, a maximum outside depth from a front face of said door to a rear face of said box being less than a depth from a front face of said wall cover panel to a rear face of said studs, said box depth providing a rear cavity behind said box and between said studs when said box is positioned between said studs with said front face of said door flush with a front face of said wall cover panel, a rear panel of said box having a first array of peg holes dispersed therethrough, said door comprising a laminar arrangement of two panels and spacers defining a door cavity therebetween, said door having a second array of peg holes dispersed through one of said two panels and a third array of peg holes being dispersed through another of said two panels.

2. A combination according to claim 1 further comprising at least one peg having a tool hanger and a mounting shank, each said peg being mountable with said hanger extending from one of a front face of said box rear panel, a rear face of said door and a front face of said door and said shank extending through one of said peg holes and beyond any one of a rear face of said box rear panel into said rear cavity, a front face of said door and a rear face of said door into said box, respectively.

3. A combination according to claim 1, said door having a depth substantially equal to a depth of said wall cover panel.

4. A combination according to claim 1, said box being substantially orthogonal.

5. A combination according to claim 1 further comprising at least one peg having a tool hanger and a mounting shank, each said peg being mountable with said hanger extending from one of a front face of said box rear panel, a rear face of a rear of said door panels and a front face of a front of said door panels and said shank extending through one of said peg holes and into said rear cavity, forwardly into said door cavity and rearwardly into said door cavity, respectively.

6. A combination according to claim 5, said door having a depth substantially equal to a depth of said wall cover panel.

7. A combination according to claim 5, said box being substantially orthogonal.

* * * * *

UNITED STATES PATENT AND TRADEMARK OFFICE

CERTIFICATE OF CORRECTION

PATENT NO. : 7,963,621 B1
APPLICATION NO. : 11/999113
DATED : June 21, 2011
INVENTOR(S) : John M. Ellis It is certified that error appears in the above-identified patent and that said Letters Patent is hereby corrected as shown below:

Title page, item (76) Inventor: John. E. Ellis should read as follows:

John M. Ellis

Signed and Sealed this
Twenty-second Day of November, 2011

David J. Kappos

David J. Kappos
*Director of the United States Patent and Trademark Office*